United States Patent [19]

Goe, Jr.

[11] 4,012,708

[45] Mar. 15, 1977

[54] OIL IMMERSIBLE CURRENT LIMITING FUSE ASSEMBLY

[75] Inventor: Melvin B. Goe, Jr., Centralia, Mo.

[73] Assignee: A. B. Chance Company, Centralia, Mo.

[22] Filed: Dec. 11, 1975

[21] Appl. No.: 639,859

[52] U.S. Cl. ..... 337/205; 337/214; 337/248

[51] Int. Cl.[2] ..... H01H 85/02

[58] Field of Search ..... 337/158, 159, 186, 201, 337/205, 214, 248

[56] References Cited

UNITED STATES PATENTS

| | | | |
|---|---|---|---|
| 3,250,879 | 5/1966 | Jacobs, Jr. | 337/248 |
| 3,356,806 | 12/1967 | Urani | 337/205 X |

*Primary Examiner*—George Harris
*Attorney, Agent, or Firm*—Schmidt, Johnson, Hovey & Williams

[57] ABSTRACT

A current limiting fuse especially adapted for installation within the oil tank of a transformer for protecting the latter from the effects of high magnitude fault currents is provided which is completely fluid-submersible and capable of withstanding severe thermal cycling without damage to the fluid-tight seals thereof. In addition, the fuses hereof are especially constructed for permitting quick, individual helium testing thereof in order to ensure that the fuses meet required safety standards. The main body of the fuse is encapsulated within a fluid-impervious casing of filled epoxy material which is penetrated by a pair of opposed, end-mounted, electrically conductive terminals each being threadably connected to the body of the fuse and bearing against a respective resilient seal member to form fluid-tight seals between the opposed terminals and the apertured ends of the encapsulating casing. In this manner leakage of oil or other contaminants between the fuse body and encapsulating material is effectively prevented during substantially all conditions encountered in practice. The seals between the casing and the terminals are preferably supplemented by a rigid, non-porous potting compound emplaced around the terminals over the respective seal areas in order to render the entire fuse assembly essentially tamperproof.

11 Claims, 5 Drawing Figures

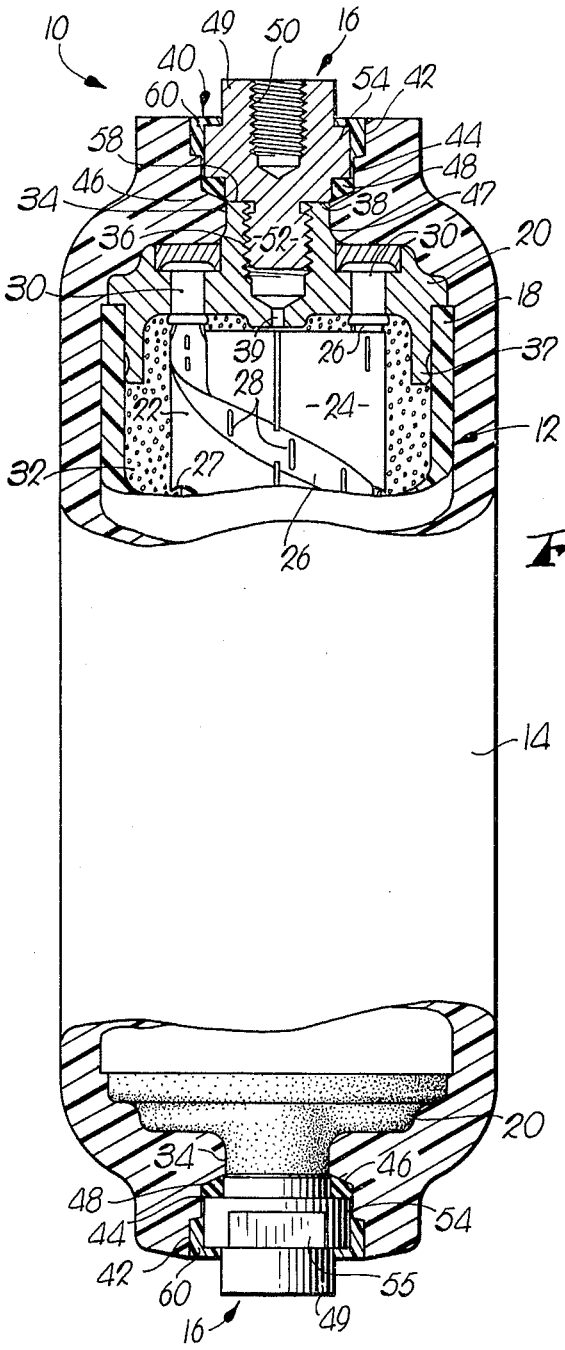
Fig.1.
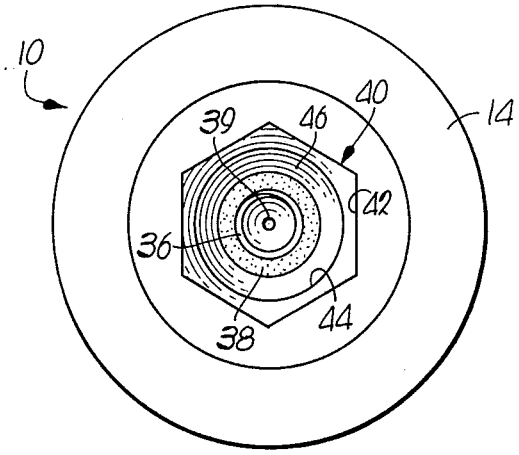
Fig.2.
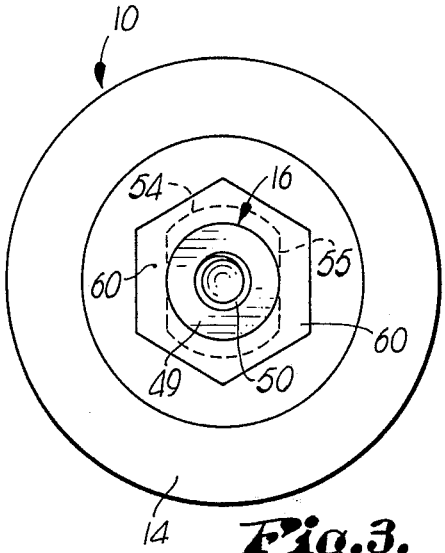
Fig.3.
Fig.4.
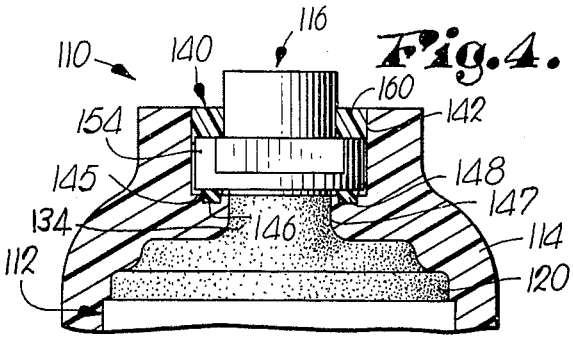
Fig.5.
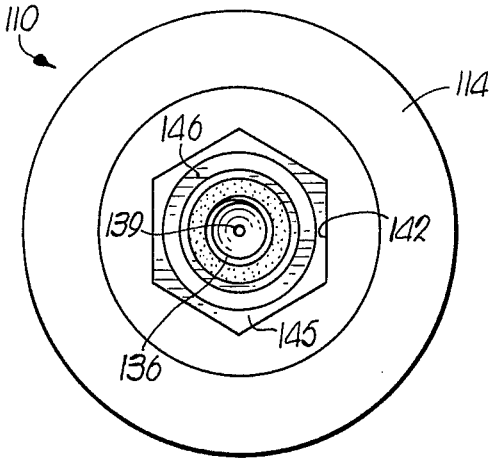

OIL IMMERSIBLE CURRENT LIMITING FUSE ASSEMBLY

This invention relates to current limiting fuses for protecting electrical appliances, and more particularly, to a current limiting fuse which is adapted for complete submersion in oil or other liquids for rendering the fuse operable as a protective device for transformers and other electrical apparatus.

Fluid-submersible current limiting fuses have long been in use for protecting transformers and the like from the potentially catastrophic effects of fault currents. For example, fluid-submersible fuses have been devised which comprise a conventional current limiting fuse encased within a ceramic member and having terminals brazed on opposed ends of the ceramic members. A persistent problem with these fuses is that they are fragile and expensive to manufacture; in addition, some types of submersible fuses have been known to fail under severe thermal cycling because of inadequate oil seals. This latter problem stems in part from the difficulty in adequately cleaning the sealing surfaces of the fuses during assembly thereof.

Other types of submersible current limiting fuses have also been proposed in an attempt to overcome the problems alluded to above. In U.S. Letters Pat. No. 3,723,930, issued Mar. 27, 1973, an oil-immersible current limiting fuse is disclosed which basically comprises a conventional current limiting fuse assembly encased within an epoxy encapsulant with a pair of opposed terminals which extend through the encapsulant for permitting installation of the fuse in a circuit to be protected. In addition, this patented fuse includes a resilient sealing band situated adjacent each end of the main body of the fuse for the purpose of leakage prevention.

However, a problem with these latter types of encapsulated fluid submersible fuses can arise by virtue of the fact that the sealing bands thereof are not in compression and therefore rely solely upon chemical bonding to the encapsulant to maintain a seal. The integrity of the seal therefore depends upon a generally less reliable chemical bond. In any event, the presence of a leakage path in such an assembly can cause the submerged current limiting fuse to violently rupture which may destroy the transformer and perhaps injure workmen in the vicinity thereof. Moreover, this problem is compounded by the fact that there is no easy method of recognizing a fluid-penetrated fuse unless a fault current is introduced across the fuse.

Accordingly, it is an important object of the present invention to provide a fluid-submersible fuse for limiting high magnitude fault currents which is adapted for use in protecting transformers and the like and is sealed within an effectively sealed, fluid-impervious casing to render the fuse completely fluid-submersible and capable of withstanding a large number of severe thermal cycles without consequent development of leakage paths or other deleterious effects which can lead to premature failure of the fuse and leave the supposedly protected electrical equipment open to the potentially disastrous effects of fault currents.

Another object of the invention is to provide a fuse which is especially constructed to facilitate individual leak testing thereof so that the manufacture can be sure that only safe fuses are sold and installed in practice; in particular the fuses hereof are apertured at respective ends thereof so that they can be helium filled during testing and thereafter checked by means of a mass spectrometer for the presence of helium leaking past the oil seals thereof.

Another object of the invention is to provide an oil-submersible current limiting fuse having an elongated fuse body housing a fusible element and having conductive, threadably secured circuit-connecting terminals at the opposed ends thereof, with the fuse being encased in insulative epoxy material and sealed by provision of resilient sealing members situated between the casing ends and corresponding fuse terminals; in this manner development of leakage paths along the length of the fuse body between the latter and the outer epoxy casing is positively precluded even in the event of extreme thermal cycling or other untoward ambient conditions encountered in use.

A still further object of the invention is to provide an encapsulated current limiting fuse having opposed, end-mounted resilient seals held in place by circuit-connecting fuse terminals wherein a potting compound is placed around the fuse terminals to permanently secure the same in place in order to increase the integrity of the fuse end seals and also to prevent tampering or the inadvertent removal of the terminals with consequent loss of seal.

In the drawing:

FIG. 1 is an elevational view in partial vertical section showing a fluid-submersible current limiting fuse in accordance with the invention with certain portions of the fuse being broken away for clarity;

FIG. 2 is a top plan view of the current limiting fuse having the threaded connection terminal and potting compound removed;

FIG. 3 is a top plan view of the embodiment illustrated in FIG. 1;

FIG. 4 is a fragmentary view in partial vertical section illustrating the seal construction of another embodiment of the invention; and FIG. 5 is a top plan view of the embodiment depicted in FIG. 4 and shown with the connection terminal potting compound removed.

In the drawing, FIG. 1 shows an oil-immersible current limiting fuse 10 which broadly comprises a conventional current limiting fuse 12 encapsulated within an insulative casing 14 of epoxy material and provided with a pair of opposed, electrically conductive circuit-connecting end terminals 16. The terminals 16 permit operative installation of fuse 10 within a circuit to be protected and also serve as a means of effectively sealing ends of casing 14 as will be described hereinafter.

Current limiting fuse 12 is similar in almost all respects to the fuse disclosed in U.S. Letters Pat. No. 3,863,187, issued Jan. 28, 1972, to Mahieu et al. In particular, fuse 12 is a high range interrupter (i.e., it generally actuates at faults of 2,000 amps or greater) and includes an elongated, tubular insulative housing 18 enclosed at the opposite ends thereof by a pair of conductive metallic end fittings or plugs 20. An insulative synthetic resin saddle member 22 is suspended within housing 18 between end fittings 20 and has a number of radially extending planar fins 24 having a plurality of cradle openings 27 along the outer margins thereof. A pair of elongate fusible elements 26 are helically wound around the saddle member 22 and are received within cradle openings 27 in order to evenly space the convolutions of the fusible elements 26. Each fusible element 26 also has a plurality of decreased cross-sectional areas or slots 28 spaced along the length thereof, and is mechanically and electrically connected at its opposite ends to the respective metallic end fittings 20 by means of conductive rivets 30. The remaining volume within housing 18 is filled with pulverulent arc-suppressing material preferably in the form of silica sand 32 which completely surrounds saddle member 22 and fusible elements 26. Other details of the construction of fuse 12 can be determined from U.S. Pat. No. 3,863,187, which is incorporated by reference herein.

Each end fitting 20 is a unitary metallic member which includes a centrally disposed, outwardly extending boss 34 having a threaded central bore 36 and an outermost, annular terminal-engaging surface 38 which defines the outermost end of the boss. A small, central, helium-testing bore 39 extends through each fitting 20 and communicates the respective bores 36 and the interior of fuse 12. In addition, each end fitting 20 includes an oppositely extending, peripheral, annular flange 37 which is positioned within housing 18 for enclosing the ends of the latter. As illustrated, each boss 34 extends through a portion of the corresponding opposed ends of casing 14 for purposes which will be described.

Casing 14 is formed of conventional, filled epoxy material (e.g., quartz or glass bead fill) and is in covering relationship to fuse 12 in order to render the entire assembly fluid-submersible. The respective ends of casing 14 include axial, inwardly extending, stepped recesses or bores 40 which are in axial alignment with the corresponding outwardly extending bosses 34 of end fittings 20. Referring specifically to the embodiment of FIG. 1, it will be seen that the walls of each bore 40 are configured to present an outermost section 42 which is hexagonal in cross section, a central section 44 of reduced diameter and circular cross section, and a lowermost circular section 47 of smallest diameter which is in surrounding engagement with the outer walls of the adjacent boss 34. In addition, an annular, inwardly inclined, continuous seal-supporting surface 46 is provided between bore-defining sections 44 and 47.

A resilient annular O-ring sealing member 48 is seated on each seal-supporting surface 46 and is also in engagement with the adjacent circular wall defining the central section 44 of each bore 40. The respective sealing members 48 are operable upon compression to effect a seal at their point of contact with casing 14 in order to prevent leakage of fluid therepast.

A unitary metallic connection terminal 16 is disposed within each respective stepped bore 40 and includes an outermost circuit-connecting end 49 extending above the level of casing 14, and an elongated, threaded shank portion 52 which is threadably secured within bore 36 of the adjacent boss 34. Each circuit-connecting end 49 includes a threaded central bore 50 for the purpose of permitting the removable installation of fuse 10 within a circuit to be protected. Each terminal 16 is also provided with a radially expanded, seal-engaging section 54 midway between the ends thereof which engages a corresponding sealing ring 48 and compresses the same against the proximal seal-supporting surface 46 and the defining sidewall of circular section 44. The innermost end of the circuit-connection portion 49 of each terminal 16 includes an annular shoulder surface 58 which complementally engages surface 38 on the adjacent boss 34 in order to limit the extent of compression of the sealing ring 48 and thus prevent the inadvertent destruction of the latter by excess tightening of the terminals 16 into place. Each section 54 is also flattened as at 55 in order to provide a gripping area for use during initial installation of the respective terminals 16. Finally, the area between each section 54 and the sidewalls of the adjacent hexagonal bore-defining section 42 is filled with a rigid, non-porous potting compound 60 for the purpose of increasing the integrity of the seal around the respective terminals and also preventing the inadvertent removal and tampering with the same after construction of fuse 10.

Turning now to FIGS. 4 and 5 wherein a second embodiment 110 of the invention is illustrated, it will be seen that fuse 112 and respective terminals 116 are identical with those described in connection with the first embodiment. However, in this instance insulative casing 114 is configured to present axially aligned, opposed recesses or bores 140 each having outermost sections 142 which are substantially hexagonal in cross-section, and an innermost, generally circular section 147 of reduced diameter which surround the adjacent upstanding portions of the corresponding bosses 134. An annular surface 145 extends between respective portions 142 and 147 of the bores 140 and is provided with a seal-supporting, inwardly extending, annular groove or gland 146 which serves to support a sealing O-ring 148. As in the case of the first embodiment, each terminal 116 includes a radially expanded portion 154 having a seal-engaging underside for compressing the sealing rings 148 into the corresponding grooves 146. Finally, the free volume within the bores 140 above the rib portions 154 of the terminal 116 is filled with a rigid nonporous potting compound 160. It will also be noted (FIG. 5) that this embodiment also includes a central helium-testing bore 139 in each end fitting 120 which communicates with the threaded bore 136.

The fuses of the present invention are preferably constructed in the following manner. First, the internal fuse assembly 12 is fabricated as shown as a separate unit and is thereafter encapsulated with the epoxy casing, leaving opposed end bores or recesses in the latter. At this point the sealing members are positioned on the complemental seal-supporting surfaces provided within the recesses and are compressed into place by installing the circuit-connecting terminals. In this respect excess compression and destruction of the sealing members is prevented by virtue of the complemental abutment surfaces on the terminals and end cap bosses respectively. At this point the fuses are each filled with helium by removing one terminal and replacing the same with an insert of foam material and a bored adapter. A double-valved T-conduit arrangement is attached to the adaptor, with one conduit leg being attached to a vacuum source, and the other to a supply of helium. A vacuum is first drawn in the fuse through the central bores 39 in the end fittings 20, at which point the vacuum line is closed and the helium line opened. This causes helium to flow into the central fuse which is filled to atmospheric pressure. The adaptor is then removed and the end terminal replaced by torquing it into the open bore 36.

After waiting a suitable length of time (e.g., several hours), the fuse is placed within a mass spectrometer test chamber for detecting the presence of leaked helium. In practice, a leak exceeding $10^{-6}$ cc/second of helium from a fuse causes rejection thereof.

It should also be noted that by virtue of the opposed end bores 39 it is possible to quickly and easily helium test the fuses. This is because a direct path between the helium filled central fuse and the end-mounted sealing rings is provided so that the integrity of the latter can be immediately checked.

After each fuse is checked for helium leakage, the end terminals are finished. This involves filling the casing bores around the terminals with potting compound as described in order to render the entire fuse essentially tamper-proof.

In practice, fuses in accordance with the invention are especially adapted for installation as a protective device within the oil tank of a pad-mounted transformer. For this purpose complemental electrical circuit connecting means (not shown) are attached to the ends 49 of the respective terminals 16 in order to place the fuse in series with the circuit to be protected. In this configuration the current limiting fuses hereof are operable in the well-known manner to limit fault currents which would otherwise be experienced by the protected transformer on other equipment. Upon experiencing a fault current of relatively high magnitude (e.g., above about 2,000 amps.) the fusible elements 26 melt and sever at the areas of decreased cross-section (and hence of maximum resistance). At the same time, the arc-suppressing silica sand surrounding the fusible elements serves to quickly quench the arcs developed during fusing in order to correspondingly limit the fault current. A further description of the operation of current limiting fuses of this type can be found in U.S. Pat. No. 3,723,930.

A prime feature of the present invention results from the unique sealing arrangement employed which serves to effectively seal the fuse ends even under the continuing stress of severe thermal cycling. That is, by virtue of the fact that casing 14 is constructed of filled epoxy material having a thermal coefficient of expansion which is close to but different than that of the metallic end caps 20 and terminals 16, the extent and rate of expansion and contraction of these components during thermal cycling will normally be different. This small differential in thermal expansion (which could led to fluid leakage between the different elements of the fuse) is effectively compensated for in the present invention by the presence of resilient sealing rings 48 between the terminals 16 and the ends of casing 14; that is, if casing 14 expands or contracts faster than the terminals 16 and thereby moves away from the terminals, the compressed rings 48 will simultaneously expand to fill any gap therebetween. This in turn prevents the surrounding fluid from seeping between the fuse body and casing and causing fuse failure. It will thus be apparent that if the resilient rings 48 were absent, the characteristic variation in thermal expansion and contraction rates could permit formation of leakage paths at the interfaces of the terminals 16 and the ends of casing 14.

Having thus described the invention, what is claimed as new and desired to be secured by Letters Patent is:

1. A current limiting fuse adapted for immersion in a fluid, said fuse comprising:

an elongate, tubular, insulative housing;

a pair of end fittings respectively attached to the opposed ends of said housing for enclosing the latter;

an elongate fusible element within said housing and adapted to sever under the influence of a fault current of predetermined magnitude for interrupting said fault current;

a unitary, insulative casing sealingly encapsulating said housing and end caps in order to render said fuse fluid-submersible, said casing being configured to present a terminal-receiving bore in at least one end thereof extending through the casing and communicating with a respective end fitting, the walls defining said bore being configured to present a continuous seal-supporting surface;

a resilient, compressible sealing member seated on said seal-supporting surface;

an electrically conductive first terminal disposed within said terminal-receiving bore and including structure in engagement with the proximal sealing member within said bore;

means biasing said terminal in a direction for compressing the sealing member against the corresponding seal-supporting surface;

a second terminal at the remaining end of said fuse; and means electrically connecting said first and second terminals to said fusible element in order to define a current path through said fuse.

2. A current limiting fuse as claimed in claim 1, wherein said casing is configured to present identical terminal-receiving bores in the opposed ends thereof, there being a sealing member positioned in each of said bores, said second terminal being identical with said first terminal, said terminals being respectively disposed within said bores and biased in a direction for compressing the sealing members.

3. A current limiting fuse as claimed in claim 2, wherein each of said end fittings is bored for communicating the interior of said housing and the corresponding terminal-receiving bores of said casing.

4. A current limiting fuse as claimed in claim 2, wherein said biasing means comprises structure connected to each of said terminals which is threadably secured to a corresponding end cap for biasing the terminal into seal-compressing engagement with the adjacent sealing member.

5. A current limiting fuse as claimed in claim 4, wherein each of said terminals is configured to present a surface in engagement with the adjacent end fitting for limiting the extent of compression of the corresponding sealing member.

6. A current limiting fuse as claimed in claim 2, wherein said each of said seal-supporting surfaces comprises the bottom wall of a continuous annular groove defined by the walls of each of said terminal-receiving bores.

7. A current limiting fuse as claimed in claim 2, wherein each of said seal-supporting surfaces comprises an annular, continuous inwardly tapered surface defined by the walls of said terminal-receiving bores.

8. A current limiting fuse as claimed in claim 2, wherein the volume of said terminal-receiving bores surrounding said terminals are filled with a rigid, nonporous potting compound.

9. A current limiting fuse as claimed in claim 2, wherein said fuse further comprises:

an elongate, insulative saddle member within said housing and having a plurality of radially extending fins, said fusible element being helically wound around said saddle member and being attached to said saddle member at a plurality of points along the length of the latter to maintain equal spacing between the convolutions of said wound fusible element;

a series of spaced zones along the length of the element within said housing having decreased cross-sectional areas relative to the remainder of the element, thereby producing increased electrical resistance at said zones, whereby, under the influence of a fault current of predetermined magnitude, said element severs at least a sufficient number of said zones to effect a limiting of said current; and pulverulent arc-suppressing material within said housing in substantially surrounding relationship to the convolutions of said element, said material being characterized by the property of acting to quickly suppress the electrical arc formed upon the severing of said fusible element under the influence of a fault current.

10. A current limiting fuse as claimed in claim 1 wherein said casing is composed of filled epoxy material.

11. A current limiting fuse adapted for immersion in a non-conductive fluid, said fuse comprising:

an elongate, tubular, insulative housing;

a pair of conductive end caps respectively attached to opposed ends of said housing for enclosing the latter, each of said end caps being provided with an outwardly extending, internally threaded, tubular boss;

an elongate, fusible element within said housing and electrically connected at the ends thereof to said end caps, said element being adapted to sever under the influence of a fault current of predetermined magnitude for interrupting the current;

a unitary, insulative casing encapsulating said housing and end caps in order to render said fuse fluid-submersible, said casing being configured to present a terminal-receiving bore at each opposed end thereof extending through the casing and communicating respectively with a said threaded tubular boss, the walls defining each of said bores being configured to present a continuous seal-supporting surface;

a resilient compressible sealing ring seated on each of said seal-supporting surfaces; and an electrically conductive terminal disposed within each of said terminal-receiving bores, each of said terminals including a first end having an externally threaded projection extending inwardly in mating engagement with said internally threaded tubular boss, an opposed second end having an internally threaded bore adapted to receive complemental electrical circuit-connecting means, and a section between said first and second ends in compressive engagement with said seal ring.

* * * * *